US011192016B2

(12) United States Patent
Stockinger

(10) Patent No.: US 11,192,016 B2
(45) Date of Patent: Dec. 7, 2021

(54) APPARATUS AND METHOD FOR THE DETECTION OF TIMING COMPONENTS IN SWIMMING POOLS

(71) Applicant: Everlast Climbing Industries, Inc., Mendota Heights, MN (US)

(72) Inventor: Chris Stockinger, Loveland, CO (US)

(73) Assignee: EVERLAST CLIMBING INDUSTRIES, INC., Mendota Heights, MN (US)

( * ) Notice: Subject to any disclaimer, the term of this patent is extended or adjusted under 35 U.S.C. 154(b) by 545 days.

(21) Appl. No.: 15/120,198

(22) PCT Filed: Feb. 20, 2015

(86) PCT No.: PCT/US2015/016742

§ 371 (c)(1),
(2) Date: Aug. 19, 2016

(87) PCT Pub. No.: WO2015/127160

PCT Pub. Date: Aug. 27, 2015

(65) Prior Publication Data

US 2017/0065875 A1 Mar. 9, 2017

Related U.S. Application Data

(60) Provisional application No. 61/942,935, filed on Feb. 21, 2014.

(51) Int. Cl.

| | |
|---|---|
| ***G04F 8/08*** | (2006.01) |
| ***A63B 71/06*** | (2006.01) |
| ***G07C 1/22*** | (2006.01) |

(52) U.S. Cl.
CPC ..... *A63B 71/0686* (2013.01); *A63B 71/0616* (2013.01); *G04F 8/08* (2013.01); *G07C 1/22* (2013.01); *A63B 2244/20* (2013.01)

(58) Field of Classification Search
CPC ..... G04F 8/08; G07C 1/22; A63B 2244/20; A63B 71/0616; A63B 71/0686
See application file for complete search history.

(56) References Cited

U.S. PATENT DOCUMENTS

| | | | | |
|---|---|---|---|---|
| 4,504,153 A * | 3/1985 | Schollmeyer | ..... | A61J 7/0481 221/2 |
| 5,088,056 A * | 2/1992 | McIntosh | ..... | A61J 7/04 340/309.7 |
| 5,537,407 A * | 7/1996 | Park | ..... | G04G 21/04 370/314 |

(Continued)

OTHER PUBLICATIONS

Banana Connector—wikipedia.org—Apr. 24, 2013.*

(Continued)

*Primary Examiner* — Sean Kayes
(74) *Attorney, Agent, or Firm* — McAndrews, Held & Malloy, Ltd.

(57) ABSTRACT

Various embodiments provide an apparatus and method to detect timing components of a timing system. A processor sends signals to timing components and compares the responses with each other and with stored characteristic responses to detect if a timing component is present, if its characteristics have changed, to identify the connected timing component, and, if communication protocols are used, exchange data.

15 Claims, 3 Drawing Sheets

(56) References Cited

U.S. PATENT DOCUMENTS

| | | | | |
|---|---|---|---|---|
| 5,552,779 | A * | 9/1996 | Gaskill | G04G 21/04 340/7.56 |
| 6,888,779 | B2 * | 5/2005 | Mollicone | A61M 21/00 368/10 |
| 6,934,220 | B1 * | 8/2005 | Cruitt | A61J 7/0481 368/10 |
| 7,119,799 | B2 | 10/2006 | Kaski et al. | |
| 7,372,014 | B1 | 5/2008 | Stebbins et al. | |
| 7,403,135 | B1 | 7/2008 | Kaski et al. | |
| 8,317,659 | B2 | 11/2012 | Woodson | |
| 8,391,104 | B2 * | 3/2013 | de La Huerga | A61J 1/035 206/459.5 |
| 8,602,815 | B2 | 12/2013 | Stockinger et al. | |
| 9,046,878 | B2 * | 6/2015 | Zheng | G04G 7/02 |
| 2001/0009398 | A1 * | 7/2001 | Sekura | A61J 7/0481 340/573.1 |
| 2003/0095476 | A1 * | 5/2003 | Mollicone | A61M 21/00 368/250 |
| 2003/0099158 | A1 * | 5/2003 | De la Huerga | A61J 7/0084 368/10 |
| 2006/0215495 | A1 * | 9/2006 | Soled | A61J 7/0481 368/10 |
| 2008/0151696 | A1 * | 6/2008 | Giroud | G04G 13/026 368/10 |
| 2012/0151093 | A1 * | 6/2012 | Zheng | G04G 7/02 709/248 |
| 2012/0221254 | A1 * | 8/2012 | Kateraas | A61B 5/02055 702/19 |
| 2012/0287758 | A1 * | 11/2012 | Lin | G04G 9/0064 368/47 |
| 2015/0057945 | A1 * | 2/2015 | White | A61B 5/0022 702/19 |

OTHER PUBLICATIONS

Controller—dictionary.com—Feb. 12, 2020.*
Processor—dictionary.com—Feb. 12, 2020.*
PCT, International Preliminary Report on Patentability, in International Application No. PCT/US2015/016742, dated Sep. 1, 2016, 5 pages.

* cited by examiner

APPARATUS AND METHOD FOR THE DETECTION OF TIMING COMPONENTS IN SWIMMING POOLS

CROSS-REFERENCE TO RELATED APPLICATIONS/INCORPORATION BY REFERENCE

The present application claims priority under 35 U.S.C. § 119(e) to provisional application Ser. No. 61/942,935 filed on Feb. 21, 2014, entitled "Apparatus and Method for Detection of Timing Components in Swimming Pools." The above referenced provisional application is hereby incorporated herein by reference in its entirety.

U.S. Pat. No. 8,602,815, issued to Stockinger et al. on Dec. 10, 2013, is incorporated by reference herein in its entirety.

FIELD OF THE INVENTION

Certain embodiments of the invention relate to electronic timing and scoring systems. More specifically, certain embodiments of the invention relate to a system and method for detecting electronic timing and scoring components installed in swimming pools for timing and scoring aquatic sports.

BACKGROUND OF THE INVENTION

Existing timing systems installed in swimming pools use timing components to measure swim times of competing athletes. Timing components can include touch pads, push-buttons, relay judging platforms, speakers, lights, or any suitable device or system that creates or presents a timing signal. One or more of these timing components may be installed at ends of each swimming lane and connected to an electronic timer through mechanisms such as connection hubs, cable harnesses, and/or wireless communication to form a timing system.

More specifically, a touch pad may be located in the water at the end of a swimming lane and can create a timing signal when touched by a swimmer. Push buttons can be activated by timing officials when a swimmer finishes a race. A relay judging platform may detect when an athlete leaves a starting block. A start system may create a start signal, a start tone, and/or a visual start signal when activated by a swim official. These timing components create timing signals, each of which may be transmitted with a two-wire connection having two contacts to an electronic timer that measures the swim time of the athletes.

Other timing components may communicate information to athletes, timing officials, and spectators. For example, one or more speakers may communicate commands and the start tone created by the start device. A light or series of lights, such as a speed light, for example, may communicate a visual start signal. The timing signals created by these timing components may be transmitted with a two-wire connection having two contacts. Additionally or alternatively, some signals and contacts may be combined into a combination plug, such as the Colorado Time Systems' combined plug configured for a relay judging platform signal and a speed light signal.

The timing components at an end of each lane may be connected to a connector hub or connections in a section of a cable harness on the pool deck. These connector hubs or harnesses are typically situated close to the beginning and end of each lane and provide mating connections for each lane to corresponding connectors of timing components. The connector hubs or harnesses themselves may be connected to the timing system.

Since these connector hubs or harnesses are adjacent to a swim lane, the connector hubs or harnesses are often repeatedly splashed with pool water. Pool water contains aggressive chemicals such as chlorine, bromine, and other chemicals that are corrosive to materials used in electrical connectors such as metals. The corrosive effect of these chemicals may be intensified by electrolysis.

U.S. Pat. No. 8,602,815, issued to Stockinger et al. on Dec. 10, 2013, which is incorporated by reference herein in its entirety, describes embodiments of connection hubs that reduce the effects of corrosion. Existing systems have used "banana plugs" to provide a large and robust connector system that can withstand some corrosion. The banana plugs are typically provided by the timing components, while the connection hubs and harnesses provide the mating banana jacks. For example, a connection hub may provide connection jacks for push buttons, a touch pad, a start input, a relay judging platform signal, a start signal output for a visual start signal, and a speaker output. A harness may provide connection jacks for a touch pad input and a button input for each lane.

The banana plugs typically include two terminals spaced at a distance of 0.75 inches. Although the corresponding jacks are typically labeled on the deck plate or cable harness, the two prong banana plugs do not provide a key system to prohibit insertion into an incorrect jack. Consequently, system malfunctions and service requests may occur when, for example, a touch pad signal is not picked up by the timer because the touch pad is plugged into the speaker output jack instead of the touch pad jack.

A swimming competition, referred to as a meet, can last several days and have several stages. First, a timer and timing components are set-up in a set-up stage. The challenge at the set-up stage is to ensure that all timing components are connected to the correct corresponding connection in the hubs or cable harnesses. Typically, a time consuming test carried out by at least two operators is performed to validate all connections.

Next, at an event stage of the meet, the challenge is that connections may be accidentally bumped and unplugged in the highly dynamic and crowded meet environment with many athletes and officials walking close by or stepping over the connections. Current systems do not have a mechanism to detect unplugged connections. Instead, any unplugged connections are typically identified only after expected timing signals are not transmitted, which in itself constitutes an error for the meet. Further, if a missing connection is discovered, inexperienced or untrained users such as meet officials or athletes often plug the timing component back into a wrong connection, causing further errors.

The last stage of the meet is the post-event analysis and dismantling of the system. Existing systems do not provide mechanisms for analyzing the health of the components and prompting user action before issues with timing components become critical.

Further limitations and disadvantages of conventional and traditional approaches will become apparent to one of skill in the art, through comparison of such systems with some aspects of the present invention as set forth in the remainder of the present application with reference to the drawings.

BRIEF SUMMARY OF THE INVENTION

A system and/or method is provided for detecting electronic timing components, substantially as shown in and/or described in connection with at least one of the figures, as set forth more completely in the claims.

These and other advantages, aspects and novel features of the present invention, as well as details of an illustrated embodiment thereof, will be more fully understood from the following description and drawings.

DETAILED DESCRIPTION OF THE INVENTION

Figure 1:
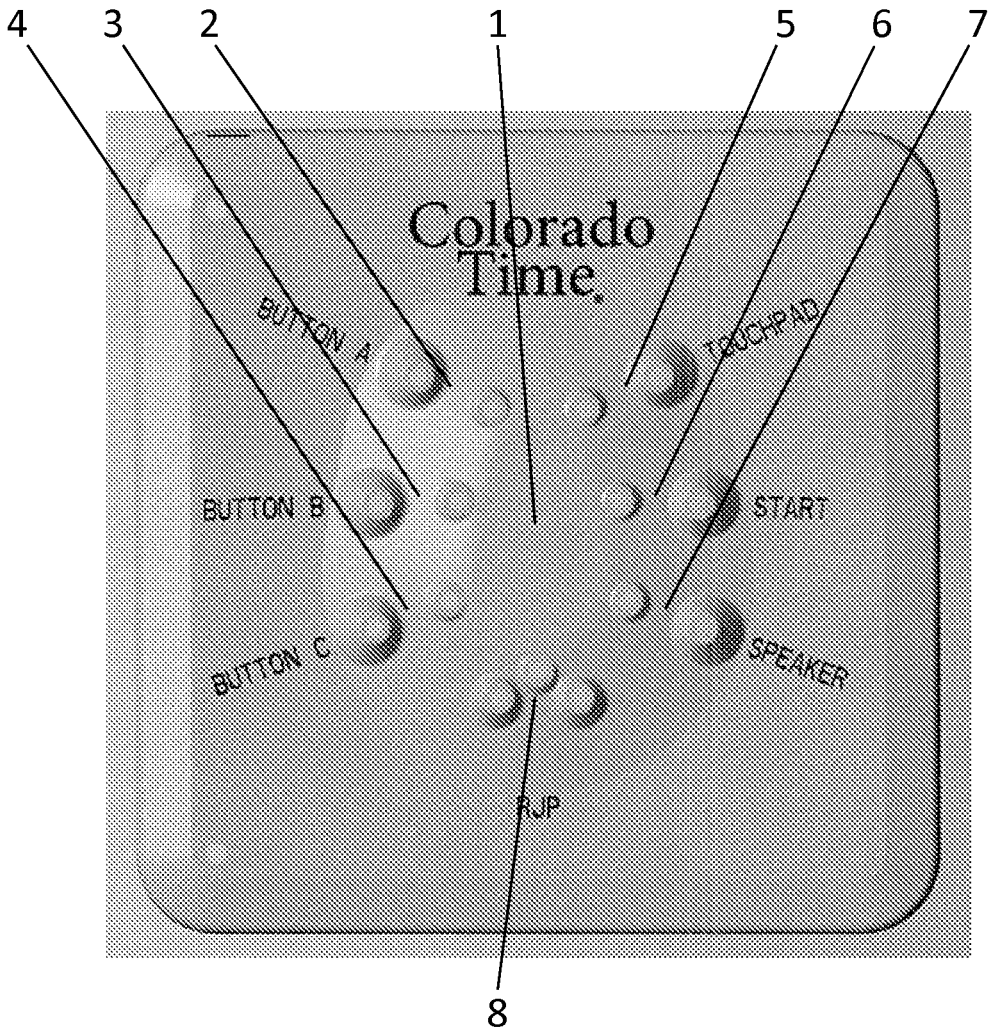
FIG. 1 is a top elevation view of an exemplary connection hub, in accordance with an embodiment of the invention.

Certain embodiments of the invention may be found in electronic timing and scoring systems and methods of use. More specifically, certain embodiments provide a system and method for detecting electronic timing and scoring components installed in swimming pools for timing and scoring aquatic sports. An example embodiment of the present invention aids users by providing the technical effect of detecting whether timing components are appropriately connected and identifying the connected timing components and characteristics of the connected timing components.

Various embodiments provide an apparatus configured to detect a timing component 14, 33 of a timing system for aquatic sports. The apparatus may comprise a connection mechanism 1, 9 configured to connect the timing component 14 to the timing system. The connection mechanism 1, 9 may comprise a communication component 2-8, 16, 18, 32, 35-38 and a processor 15. The communication component 2-8, 16, 18, 32, 35-38 may be configured to send signals 22 to and receive responses 23-26 from the connected timing component 14, 33. The processor 15 may be configured to generate the signals 22 and store the responses 23-26 to the signals 22 from the connected timing component 14, 33. The processor 15 may also be configured to compare each of the responses 23-26 to different responses 23-26 and/or stored characteristic component responses. The processor 15 may be configured to determine, based on the comparisons, a connection status of the connected timing component 14, 33, an identity of the connected timing component 14, 33, and/or if a characteristic of the connected timing component 14, 33 has changed.

As used herein, the terms "exemplary" or "example" means serving as a non-limiting example, instance, or illustration. As used herein, the term "e.g." introduces a list of one or more non-limiting examples, instances, or illustrations.

The foregoing summary, as well as the following detailed description of certain embodiments will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (e.g., processors) may be implemented in a single piece of hardware (e.g., a general purpose signal processor or a block of random access memory, hard disk, or the like) or multiple pieces of hardware. Similarly, the programs may be stand-alone programs, may be incorporated as subroutines in an operating system, may be functions in an installed software package, and the like. It should be understood that the various embodiments are not limited to the arrangements and instrumentality shown in the drawings. It should also be understood that the embodiments may be combined, or that other embodiments may be utilized and that structural, logical and electrical changes may be made without departing from the scope of the various embodiments of the present invention. The following detailed description is, therefore, not to be taken in a limiting sense, and the scope of the present invention is defined by the appended claims and their equivalents As used herein, an element recited in the singular and proceeded with the word "a" or "an" should be understood as not excluding plural of the elements, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Furthermore, the term processor or processing unit, as used herein, refers to any type of processing unit that can carry out the required calculations needed for the invention, such as single or multi-core: CPU, Graphics Board, DSP, FPGA, ASIC or a combination thereof.

FIG. 1 is a top elevation view of an exemplary connection hub 1, in accordance with an embodiment of the invention. Referring to FIG. 1, the connection hub 1 comprises a connection 2 for button A, a connection 3 for button B, a connection 4 for button C, a connection 5 for a touch pad, a connection 6 for a start device, a connection 7 for a speaker, and a combined connection for a relay judging platform (RJP) with a speed light. Connections 2-7 may be, for example, two-pronged connections. Connection 8 may be a three-pronged connection or any suitable connection. In various embodiments, one or more of the connections, such as connections 2-6, may be equipped with a voltage step response detector as described below. Additionally and/or alternatively, one or more of the connections, such as start device connection 6, may be equipped with a signature detector having, for example, a serial port allowing for bi-directional serial communication. In an exemplary embodiment, one or more of the connections, such as connection 6, may be symmetrical such that a banana plug of the start system can be operable for communication while plugged in with either polarity.

Figure 2:
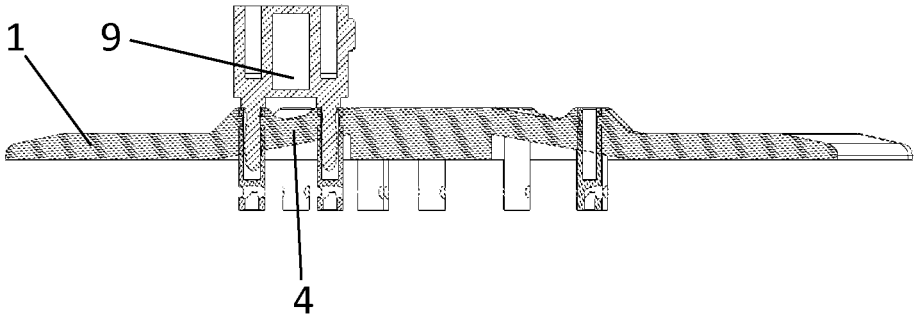
FIG. 2 is a side section view of an exemplary plug inserted into a connection hub, in accordance with an embodiment of the invention.

FIG. 2 is a side section view of an exemplary plug 9 inserted into a connection hub 1, in accordance with an embodiment of the invention. Referring to FIG. 2, a banana plug 9 connected to a timing component, such as a touch pad, is inserted in a jack 4 of connection hub 1 corresponding with button C. Banana plug 9 can be mechanically plugged into any connection 2-7 in any polarity because connections 2-7 are structurally similar. An incorrect timing signal is provided, however, when a banana plug 9 of a timing component is inserted into an improper connection 2-7. For example, connection 5 labeled "touchpad" is the correct connection for inserting the banana plug 9 of a touch pad. Inserting banana plug 9 of a touch pad into button C jack 4 as illustrated in FIG. 2, for example, creates an incorrect timing signal in the system.

Figure 3:
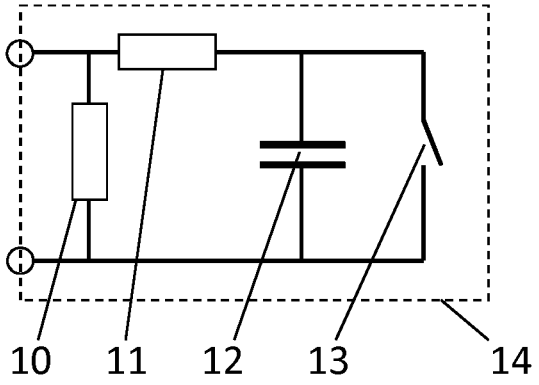
FIG. 3 is a circuit diagram of an exemplary timing component, in accordance with an embodiment of the invention.

FIG. 3 is a circuit diagram of an exemplary timing component 14, in accordance with an embodiment of the invention. Referring to FIG. 3, the timing component 14 with a simplified electrical equivalent circuit for touch pads, push buttons, and relay starting platforms comprises resistors 10, 11, capacitor 12, and switch 13. In an exemplary embodiment, resistor 10 may be nearly infinite, resistor 11 is very small (e.g., a few Ohms), and capacitor 12 is small (e.g., a few 100 picofarad) for a push button timing component. For a touch pad, resistor 10 may be nearly infinite, resistor 11 is very small (e.g., a few Ohms), and capacitor 12 is larger (e.g., a few 10 nanofarad). For a relay judging platform, resistor 10 may be large (e.g., a few 100 kilo Ohms), resistor 11 is very small (e.g., a few Ohms), and capacitor 12 is large (e.g., a few microfarad). The switch 13 of the timing component 14 is open when a step response is measured to retrieve a meaningful response.

Figure 4:
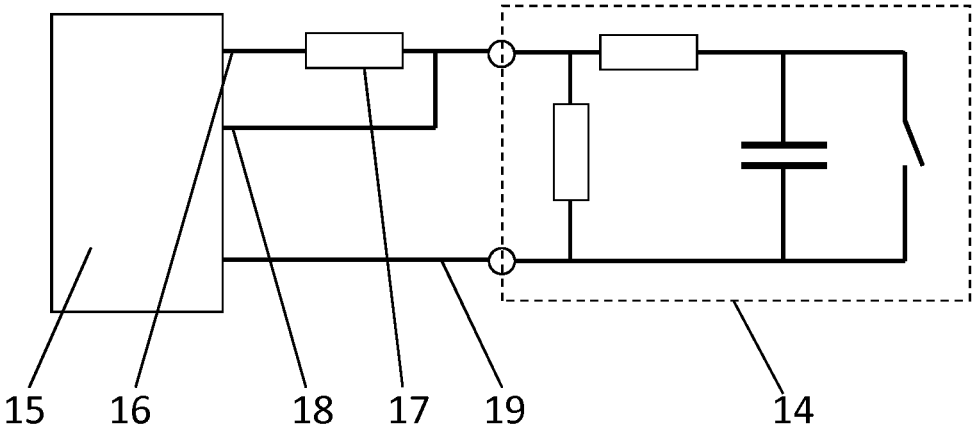
FIG. 4 is circuit diagram of an exemplary step response detector connected to a timing component, in accordance with an embodiment of the invention.

FIG. 4 is circuit diagram of an exemplary step response detector connected to a timing component 14, in accordance with an embodiment of the invention. Referring to FIG. 4, the step response detector may comprise a processor 15, an output 16, an input 18, a current return path 19, and a resistor 17. The processor 15 includes an output 16 that it can switch in a step, for example, from 0V to its power voltage. The resistor 17, which may be a few kilo Ohms or any suitable value, limits the current flowing into the timing component 14 and contributes to the timing component signature. Connection 19 is the current return path to the processor 15 from the timing component 14. In various embodiments, each voltage step produced by processor 15, such as from 1V to 2V in a 3.3V system, can be used to acquire a step response from the timing component 14 at input 18. The processor 15 registers the voltage curve that is characteristic for the timing component 14 that is received at input 18. The voltage curve, i.e., voltage over time, represents the component signature.

In a representative embodiment, the step response detector may be provided in banana connections 9 or any suitable system component. The step response detector 15 identifies a proper connection and/or a connected timing component 14 based on responses to a step function, which are different for different timing components. More specifically, a voltage step applied by a processor 15 to a timing component 14 results in a response that is characteristic for a given timing component. These responses, also referred to as component signatures, are recorded in a memory of processor 15 during the step function acquisition process. The processor 15 can compare an acquired signature with a set of known characteristic component signatures for timing components 14 that can be expected to be plugged into a particular connection 2-7. The processor 14 determines which timing component is plugged into the connection 2-7 based on the similarity of the received signature to the stored characteristic component signatures.

Figure 5A:
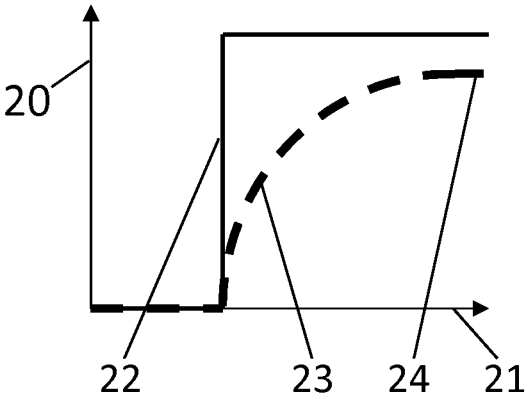
FIG. 5A is a graph illustrating an exemplary measured response to an applied step voltage over time, the measured response having a long rise time, in accordance with an embodiment of the invention.
Figure 5B:
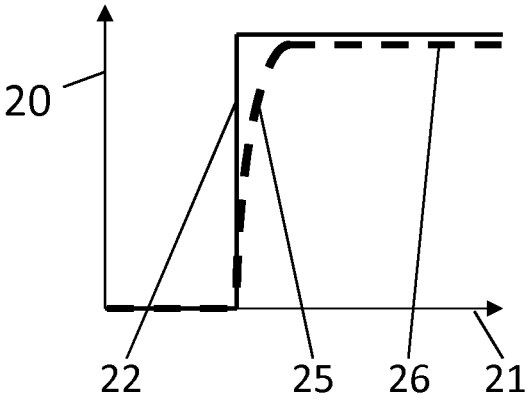
FIG. 5B is a graph illustrating an exemplary measured response to an applied step voltage over time, the measured response having a short rise time, in accordance with an embodiment of the invention.

FIG. 5A is a graph illustrating an exemplary measured response 23, 24 to an applied step voltage 22 over time 21, the measured response having a long rise time 23, in accordance with an embodiment of the invention. FIG. 5B is a graph illustrating an exemplary measured response 25, 26 to an applied step voltage 22 over time, the measured response having a short rise time 25, in accordance with an embodiment of the invention. Referring to FIGS. 5A and 5B, a step voltage 22 that is produced by the output 16 of the processor 15 and exemplary voltage curves 23-26 used as component signatures are illustrated in graphs where the y-axis 20 corresponds with voltage and the x-axis 21 corresponds with time. The component signature 23, 24 of FIG. 5A measured at the input 18 of processor 15 is characteristic of a rather large capacitor 12 value and a smaller parallel resistor 10 value because the rise time 23 is relatively long and the steady voltage 24 is relatively low. In contrast, the component signature 25, 26 in FIG. 5B comprises a rather fast voltage rise 25 signifying a small capacitor 12 value and a relatively high steady voltage 26 specifying a large parallel resistor 10 value.

In an exemplary embodiment, the voltage curve for a push button timing component may quickly rise from 0V to the power voltage and stay at the power voltage. For a touchpad, the voltage curve may rise more slowly from 0V to the power voltage and stay at the power voltage. The voltage curve for a relay judging platform may rise slowly from 0V to the power voltage and stay below the power voltage because its parallel resistor 10 causes a voltage drop on resistor 17. As noted above, the switch 13 is open during the acquisition of the step response so as not to skew the results. For example, if the switch is closed, a characteristic voltage curve may be close to 0V.

In a representative embodiment, speaker and speed light components do not have switch 13 and should not be coupled with connections 2-6 equipped with a voltage step response detector. For example, a speaker connected in error to a connector with a step response detector circuit presents a very low parallel resistance 10 and therefore a voltage curve close to 0V. A speed light connected in error presents a voltage curve that rises at a rate between a touch pad and push button based on a very high parallel resistance 10 value and the capacitance 12 value being between a touch pad and a push button. A start system coupled to a connection not having a signature detector presents a capacitance 12 value of about a touch pad but a smaller parallel resistor 10 value than a relay judging platform. Accordingly, the voltage curve of a start system connected in error rises at a similar rate as for a touch pad but would stay further below the upper step voltage.

Figure 6A:
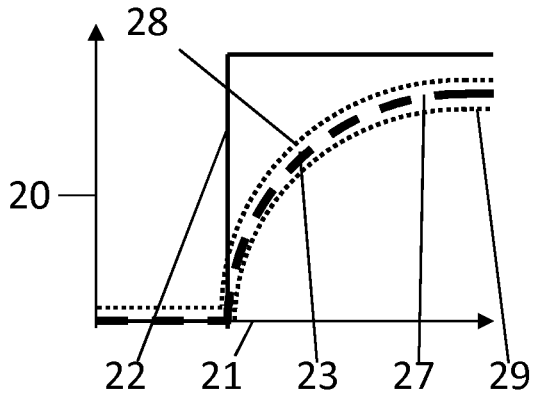
FIG. 6A is a graph illustrating an exemplary measured response to an applied step voltage over time, the measured response having a long rise time and a tolerance range, in accordance with an embodiment of the invention.
Figure 6B:
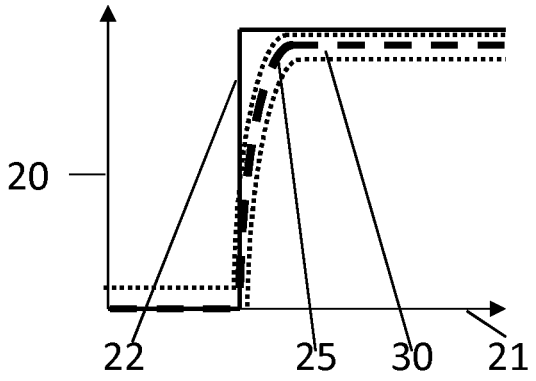
FIG. 6B is a graph illustrating an exemplary measured response to an applied step voltage over time, the measured response having a short rise time and a tolerance range, in accordance with an embodiment of the invention.

FIG. 6A is a graph illustrating an exemplary measured response 23 to an applied step voltage over time, the measured response having a long rise time 23 and a tolerance range 27, in accordance with an embodiment of the invention. FIG. 6B is a graph illustrating an exemplary measured response 25 to an applied step voltage over time, the measured response having a short rise time 25 and a tolerance range 30, in accordance with an embodiment of the invention.

Measured component signatures 23, 25 have a certain variation of their values because of the tolerances of parameters of the timing components 14 such as contact conductivity (which can vary with corrosion), cable capacitance, device capacitance, device power requirement and others. The algorithms executed by the processor 15 may take these tolerance fields or ranges 27, 30 into account when determining which stored characteristic component signature the measured signature fits best. The processor 15 can also compare the deduced result with a pre-determined, expected timing component 14 in the plug and may generate user messages and perform further processing based on if the expected timing component is detected. If no stored component characteristic signature fits within the tolerance fields 27, 30, the processor may communicate the result and perform further processing.

For example, referring to FIG. 6A, a measured voltage rise 23 interpreted as a component signature is compared within a range 27 of the values of a characteristic component signature with upper limits 28 and lower limits 29 to find congruency to correlate a given timing component 14 to the characteristic component signature. FIG. 6B illustrates a different example of a fit of a measured voltage rise 25 interpreted as component signature compared within the range 30 of a characteristic component signature.

Various embodiments provide that processor 15 may acquire consecutive signatures to determine whether a timing component is still present or has kept its properties after having been initially detected in the first place. The acquired signatures may be compared with each other, in addition to or instead of using the characteristic component signatures. For example, the processor 15 can deduce that the timing component 14 has changed or has become disconnected if the consecutive acquired signatures are different. The characteristics of timing components 14 may change during use, for example, when a push button falls into the water and the switch gets wet, when water splashes onto the connections and shortcuts some of the signal, or when a touchpad becomes defective during use, among other things. The acquired signatures can be used to diagnose causes for detected changes in characteristics.

Certain embodiments provide additional and/or alternative strategies to prevent timing components 14 from being plugged into the wrong corresponding connectors 2-8. For example, in a representative embodiment, one or more of the timing components 14 may have physically different plugs 9 and corresponding jacks 2-8 of a connection hub 1 and/or cable harness. The plugs 9, for example, may comprise two extra pins and the connection hub 1 and/or cable harness can include a mechanism for detecting the pins such that the system may determine whether the timing component 14 is connected.

Figure 7:
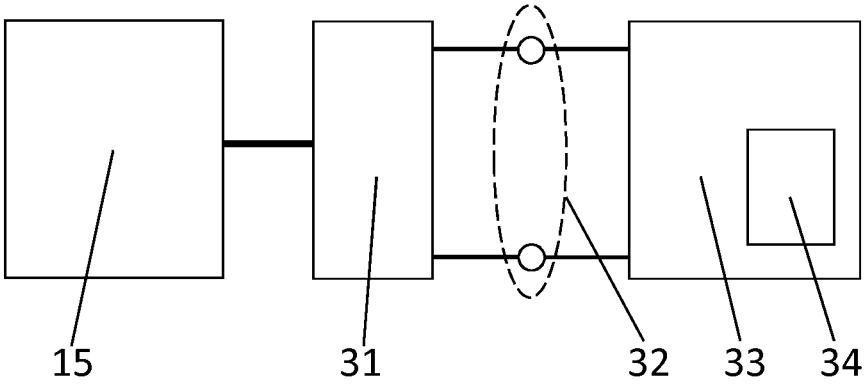
FIG. 7 is a circuit diagram of an exemplary system processor communicatively coupled with a timing component processor, in accordance with an embodiment of the invention.

FIG. 7 is a circuit diagram of an exemplary system processor 15 communicatively coupled with a timing component processor 34, in accordance with an embodiment of the invention. Referring to FIG. 7, a processor 15 includes and/or is connected with a circuitry 31 configured to allow a plug connection 32 with a timing component 33 in either polarity. The timing component 33 may comprise a processor 34 that may communicate with system processor 15 using known electronic communication protocols through the plug connection 32. For example, the system processor 15 and the timing component processor 34 may communicate by serial protocols (e.g., an RS232 protocol), modulation of carrier protocols, or any suitable protocol. The timing component processor 34 may provide signatures to system processor 15 such that the processor 15 may detect if the timing component 33 is present and identify the timing component 33 type. The processors 15, 34 may be configured to exchange information, such as device states and the like, once connected.

In certain embodiments, if a connected timing component processor 34 does not respond to a signature request via a communication protocol, the system processor 15 may generate a voltage step 22 and process a received step response as described above. Moreover, analysis of a step response may be performed to evaluate changes in timing component characteristics, among other things, even if the timing component processor 34 does return a signature.

Figure 8:
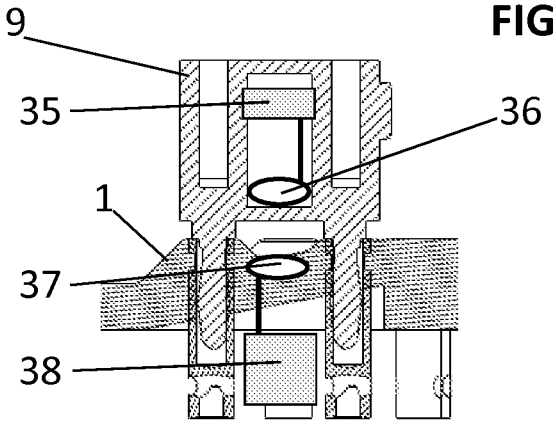
FIG. 8 is a side section view of an exemplary plug inserted into and wirelessly connected with a connection hub, in accordance with an embodiment of the invention.

FIG. 8 is a side section view of an exemplary plug 9 inserted into and wirelessly connected with a connection hub 1, in accordance with an embodiment of the invention. Referring to FIG. 8, a timing component plug 9 and connection hub 1 or cable harness may each comprise a transceiver 35, 38 and antenna 36, 37. The transceiver 38 sends its wireless signals via an antenna 37 to the closely placed antenna 36 of the plug transceiver 35. The close spatial placement of the antennas 37 and 36 allows distinguishing the signals from transceivers 38 and 35 from signals from other transceiver pairs plugged in nearby. The communication and detection process of exchanged signatures proceeds as described above. In a representative embodiment, the wireless communication can be performed in conformance with the RFID protocol.

In accordance with various embodiments of the invention, an apparatus configured to detect a timing component 14, 33 of a timing system for aquatic sports is provided. The apparatus may comprise a connection mechanism 1, 9 configured to connect the timing component 14 to the timing system. The connection mechanism 1, 9 may comprise a communication component 2-8, 16, 18, 32, 35-38 and a processor 15. The communication component 2-8, 16, 18, 32, 35-38 may be configured to send signals 22 to and receive responses 23-26 from the connected timing component 14, 33. The processor 15 may be configured to generate the signals 22 and store the responses 23-26 to the signals 22 from the connected timing component 14, 33. The processor 15 may also be configured to compare each of the responses 23-26 to different responses 23-26 and/or stored characteristic component responses. The processor 15 may be configured to determine, based on the comparisons, a connection status of the connected timing component 14, 33, an identity of the connected timing component 14, 33, and/or if a characteristic of the connected timing component 14, 33 has changed.

In various embodiments, at least one of the signals is a step voltage 22. In certain embodiments, at least one of the received responses is a step response 23-26 representing a component signature of the connected timing component 14, 33. In a representative embodiment, at least one of the sent signals is transmitted according to at least one electronic communication protocol. In various embodiments, the sent signals comprise consecutively a step voltage 22 and a signal transmitted according to at least one electronic communication protocol. In certain embodiments, the at least one electronic communication protocol is used to communicate data, states, and signals. In a representative embodiment, the timing component 14, 33 comprises a processor 34. One or more of the received responses is provided by the processor 34 of the timing component 14, 33 to the processor 15 of the connection mechanism according to the at least one electronic communication protocol. In various embodiments, the at least one electronic communication protocol is an RS232 protocol.

In certain embodiments, the timing component 14, 33 comprises at least one of a plug 9 and a jack. In a representative embodiment, the timing system comprises at least one of a jack 2-8 and a plug operable to mate with a corresponding at least one of the plug 9 and the jack of the timing component 14, 33. In various embodiments, each of the at least one of the jack 2-8 and the plug of the timing system and the corresponding at least one of the plug 9 and the jack of the timing component 14, 33 comprises a transceiver 35, 38 and an antenna 36, 37. In certain embodiments, the transceiver 35, 38 and the antenna 36, 37 of each of the at least one of the jack 2-8 and the plug of the timing system and the corresponding at least one of the plug 9 and the jack of the timing component 14, 33 communicate according to an RFID protocol.

In a representative embodiment, each of the at least one of the jack 2-8 and the plug of the timing system and the corresponding at least one of the plug 9 and the jack of the timing component 14, 33 is unique to a type of the timing component 14, 33. In various embodiments, the at least one of the jack 2-8 and the plug of the timing system is integrated in one or more of a connection hub 1 and a cable harness. In certain embodiments, the plug is a two-pronged banana plug 9. In a representative embodiment, the apparatus comprises circuitry 31 configured for receiving the two-pronged banana plug 9 at the jack 2-7 in either polarity.

In various embodiments, the stored characteristic responses comprise a tolerance range having an upper limit and a lower limit. In certain embodiments, the timing component 14, 33 comprises a switch 13 that is in an open position when providing the responses 23-26 to the signals 22. In a representative embodiment, the timing component 14, 33 is one or more of a touch pad, a push button, and a start device. In various embodiments, the timing component 14, 33 is one or more of a speaker and a relay judging platform (RJP) with a speed light.

As utilized herein the term "circuitry" refers to physical electronic components (i.e. hardware) and any software and/or firmware ("code") which may configure the hardware, be executed by the hardware, and or otherwise be associated with the hardware. As used herein, for example, a particular processor and memory may comprise a first "circuit" when executing a first one or more lines of code and may comprise a second "circuit" when executing a second one or more lines of code. As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, circuitry is "operable" to perform a function whenever the circuitry comprises the necessary hardware and code (if any is necessary) to perform the function, regardless of whether performance of the function is disabled, or not enabled, by some user-configurable setting.

Other embodiments of the invention may provide a computer readable device and/or a non-transitory computer readable medium, and/or a machine readable device and/or a non-transitory machine readable medium, having stored thereon, a machine code and/or a computer program having at least one code section executable by a machine and/or a computer, thereby causing the machine and/or computer to perform the steps as described herein for detecting whether timing components are appropriately connected and identifying the connected timing components and characteristics of the connected timing components.

Accordingly, the present invention may be realized in hardware, software, or a combination of hardware and software. The present invention may be realized in a centralized fashion in at least one computer system, or in a distributed fashion where different elements are spread across several interconnected computer systems. Any kind of computer system or other apparatus adapted for carrying out the methods described herein is suited. A typical combination of hardware and software may be a general-purpose computer system with a computer program that, when being loaded and executed, controls the computer system such that it carries out the methods described herein.

The present invention may also be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

Although devices, methods, and systems according to the present invention may have been described in connection with a preferred embodiment, it is not intended to be limited to the specific form set forth herein, but on the contrary, it is intended to cover such alternative, modifications, and equivalents, as can be reasonably included within the scope of the invention as defined by this disclosure and appended diagrams.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. An apparatus comprising:

a connection mechanism configured to connect a controllerless timing component to a swim timing system, the controllerless timing component configured to be positioned in or adjacent a swimming pool and operable to transmit timing signals to the swim timing system for scoring an aquatic sport, the connection mechanism comprising:

a communication component configured to send signals to the connected controllerless timing component and receive component signatures from the connected controllerless timing component in response to the sent signals, wherein the component signatures are responses identifying at least one physical characteristic of the controllerless timing component; and a processor having a memory, the processor and the memory disposed in the connection mechanism, the processor configured to:

generate the signals sent to the connected controllerless timing component via the communication component;

store in the memory the component signatures received via the communication component from the connected controllerless timing component in response to the sent signals;

compare each of the component signatures to at least one of:

a different one or more of the component signatures stored in the memory, and characteristic component signatures stored in the memory; and determine, based on the comparisons, at least one of:

a connection status of the connected controllerless timing component, a timing component type of the connected controllerless timing component, and if a component signature of the connected controllerless timing component has changed based on the comparison to the different one or more of the component signatures stored in the memory.

2. The apparatus according to claim 1, wherein at least one of the signals is a step voltage.

3. The apparatus according to claim 1, wherein at least one of the received component signatures is a step response of the connected controllerless timing component.

4. The apparatus according to claim 1, wherein the connection mechanism comprises a first housing having at least one of a plug and a jack connected to the controllerless timing component.

5. The apparatus according to claim 4, wherein the connection mechanism comprises a second housing having at least one of a jack and a plug connected to the swim timing system and operable to mate with a corresponding at least one of the plug and the jack connected to the controllerless timing component.

6. The apparatus according to claim 5, wherein each of the first housing and the second housing comprises a transceiver and an antenna.

7. The apparatus according to claim 6, wherein the transceiver and the antenna of each of the first housing and the second housing communicate according to an RFID protocol.

8. The apparatus according to claim 5, wherein the each of the at least one of the jack and the plug connected to the swim timing system and the corresponding at least one of the plug and the jack connected to the controllerless timing component is unique to the timing component type.

9. The apparatus according to claim 5, wherein the at least one of the jack and the plug connected to the swim timing system is integrated in one or more of:

a connection hub, and a cable harness.

10. The apparatus according to claim 5, wherein the plug is a two-pronged banana plug.

11. The apparatus according to claim 10, comprising circuitry configured for receiving the two-pronged banana plug at the jack in either polarity.

12. The apparatus according to claim 1, wherein the characteristic component signatures stored in the memory comprise a tolerance range having an upper limit and a lower limit.

13. The apparatus according to claim 1, wherein the controllerless timing component comprises a switch that is in an open position when providing the component signatures in response to the signals.

14. The apparatus according to claim 13, wherein the controllerless timing component is one or more of:

a touch pad, a push button, and a start device.

15. The apparatus according to claim 1, wherein the controllerless timing component is one or more of:

a speaker, and a relay judging platform (RJP) with a speed light.

* * * * *